US006886313B2

(12) United States Patent
Knoerzer et al.

(10) Patent No.: US 6,886,313 B2
(45) Date of Patent: May 3, 2005

(54) METHOD AND APPARATUS FOR MAKING FLAT BOTTOM BAGS

(75) Inventors: Anthony Robert Knoerzer, Plano, TX (US); Garrett William Kohl, Allen, TX (US); Steven Kenneth Tucker, Hurst, TX (US)

(73) Assignee: Frito-Lay North America, Inc., Plano, TX (US)

( * ) Notice: Subject to any disclaimer, the term of this patent is extended or adjusted under 35 U.S.C. 154(b) by 0 days.

(21) Appl. No.: 10/778,555

(22) Filed: Feb. 13, 2004

(65) Prior Publication Data

US 2004/0159081 A1 Aug. 19, 2004

Related U.S. Application Data

(60) Division of application No. 10/124,669, filed on Apr. 17, 2002, now Pat. No. 6,729,109, which is a continuation-in-part of application No. 10/100,370, filed on Mar. 18, 2002, now Pat. No. 6,722,106.

(51) Int. Cl.[7] ..... B65B 9/20
(52) U.S. Cl. ..... 53/551; 53/201
(58) Field of Search ..... 53/201, 450, 469, 53/551, 552, 451; 493/418, 218, 248, 256, 440

(56) References Cited

U.S. PATENT DOCUMENTS

| | | | | |
|---|---|---|---|---|
| 3,537,636 A | | 11/1970 | Rochette | |
| 3,785,112 A | | 1/1974 | Leasure et al. | |
| 3,785,636 A | * | 1/1974 | Bitting et al. | 493/418 |
| 4,061,326 A | * | 12/1977 | Proudman | 493/418 |
| 4,194,438 A | | 3/1980 | Schmachtel | |
| 4,597,103 A | | 6/1986 | Hoover | |
| 4,604,854 A | | 8/1986 | Andreas | |
| 4,894,975 A | | 1/1990 | Ausnit | |
| 4,913,561 A | | 4/1990 | Beer | |
| 4,925,438 A | | 5/1990 | Wagner | |
| 4,986,054 A | | 1/1991 | McMahon | |
| 5,030,190 A | | 7/1991 | Woods et al. | |
| 5,046,300 A | | 9/1991 | Custer et al. | |
| 5,127,208 A | | 7/1992 | Custer et al. | |
| 5,170,608 A | | 12/1992 | Petry et al. | |
| 5,242,516 A | | 9/1993 | Custer et al. | |
| 5,246,416 A | * | 9/1993 | Demura et al. | 493/443 |
| 5,322,579 A | | 6/1994 | Van Erden | |

(Continued)

FOREIGN PATENT DOCUMENTS

| | | |
|---|---|---|
| GB | Des. 2101909 | 5/2001 |
| JP | 2191159 | 7/1990 |
| WO | PCT/FR93/00303 | 10/1993 |

*Primary Examiner*—John Sipos
(74) *Attorney, Agent, or Firm*—Colin P. Cahoon; Chad E. Walter; Carstens & Cahoon, LLP

(57) ABSTRACT

A flat bottom bag or flexible package, and method for manufacturing same, constructed by modification to existing vertical form and fill packaging machines. The invention involves producing a flat bottom bag from a single sheet of packaging film by creating two vertical creases along opposite sides of a packaging film tube prior to forming a transverse seal on the tube. These creases are formed using fixed or stationary modifications to prior art vertical form, fill, and seal machines.

5 Claims, 5 Drawing Sheets

U.S. PATENT DOCUMENTS

| | | | | |
|---|---|---|---|---|
| 5,398,486 | A | | 3/1995 | Kauss et al. |
| 5,400,565 | A | | 3/1995 | Terminella et al. |
| RE34,905 | E | | 4/1995 | Ausnit |
| 5,412,924 | A | | 5/1995 | Ausnit |
| 5,425,216 | A | | 6/1995 | Ausnit |
| 5,435,802 | A | * | 7/1995 | Kober ..... 493/418 |
| 5,505,037 | A | | 4/1996 | Terminella et al. |
| 5,551,208 | A | | 9/1996 | Van Erden |
| 5,561,966 | A | | 10/1996 | English |
| 5,564,259 | A | | 10/1996 | Stolmeier |
| 5,590,783 | A | | 1/1997 | Capy et al. |
| 5,746,043 | A | | 5/1998 | Terminella et al. |
| 5,768,852 | A | | 6/1998 | Terminella et al. |
| 5,862,652 | A | | 1/1999 | Schoeler |
| 5,930,983 | A | | 8/1999 | Terminella et al. |
| 6,029,428 | A | | 2/2000 | Terminella et al. |
| 6,047,521 | A | | 4/2000 | Terminella et al. |
| 6,145,282 | A | | 11/2000 | Tsuruta |
| 6,398,412 | B2 | | 6/2002 | Wedi et al. |
| 6,615,567 | B2 | | 9/2003 | Kuhn et al. |
| 2003/0009989 | A1 | | 1/2003 | Knoerzer et al. |

* cited by examiner

FIG. 3a
(PRIOR ART)
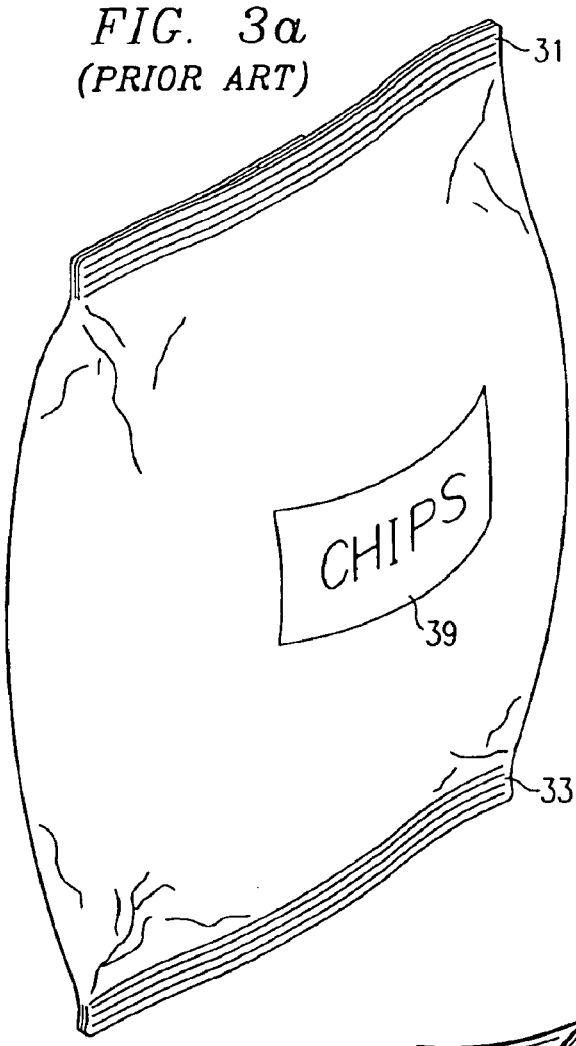
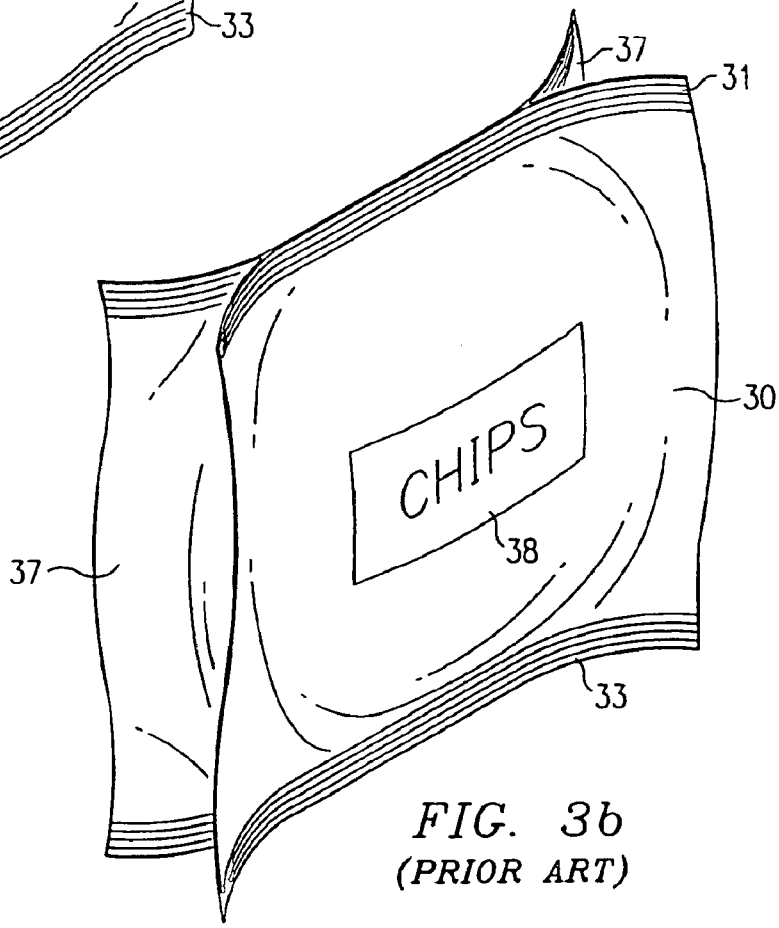
FIG. 3b
(PRIOR ART)

METHOD AND APPARATUS FOR MAKING FLAT BOTTOM BAGS

This application is a division of Ser. No. 10/124,669, filed on Apr. 17, 2002, now U.S. Pat. No. 6,729,109 which is a continuation-in-part of U.S. application Ser. No. 10/100,370 filed on Mar. 18, 2002 now U.S. Pat. No. 6,722,106.

BACKGROUND OF THE INVENTION

1. Technical Field

The present invention relates to a flat bottom bag having vertical gussets constructed using a modified vertical form, fill, and seal packaging machine, and the method for making same, that provides for a single piece construction of a stand-up bag suitable for retail snack food distribution. The invention allows for use of existing film converter and packaging technology to produce a stand-up package with minimal increased costs and minimal modifications.

2. Description of Related Art

Vertical form, fill, and seal packaging machines are commonly used in the snack food industry for forming, filling, and sealing bags of chips and other like products. Such packaging machines take a packaging film from a sheet roll and forms the film into a vertical tube around a product delivery cylinder. The vertical tube is vertically sealed along its length to form a back seal. The machine applies a pair of heat-sealing jaws or facings against the tube to form a horizontal transverse seal. This transverse seal acts as the top seal on the bag below and the bottom seal on the package being filled and formed above. The product to be packaged, such as potato chips, is dropped through the product delivery cylinder and formed tube and is held within the tube above the bottom transverse seal. After the package has been filled, the film tube is pushed downward to draw out another package length. A transverse seal is formed above the product, thus sealing it within the film tube and forming a package of product. The package below said transverse seal is separated from the rest of the film tube by cutting horizontally across the sealed area.

The packaging film used in such process is typically a composite polymer material produced by a film converter. For example, one prior art composite film used for packaging potato chips and like products is illustrated in FIG. 1, which is a schematic of a cross-section of the film illustrating each individual substantive layer. FIG. 1 shows an inside, or product side, layer 16 which typically comprises metalized oriented polypropylene ("OPP") or metalized polyethylene terephtalate ("PET"). This is followed by a laminate layer 14, typically a polyethylene extrusion, and an ink or graphics layer 12. The ink layer 12 is typically used for the presentation of graphics that can be viewed through a transparent outside layer 10, which layer 10 is typically OPP or PET.

The prior art film composition shown in FIG. 1 is ideally suited for use on vertical form and fill machines for the packaging of food products. The metalized inside layer 16, which is usually metalized with a thin layer of aluminum, provides excellent barrier properties. The use of OPP or PET for the outside layer 10 and the inside layer 16 further makes it possible to heat seal any surface of the film to any other surface in forming either the transverse seals or back seal of a package. Alternatively, a material can be used on the outside layer 12 that will not seal on itself, such as a paper layer or a non-sealing polymer layer, so that only the inside layer 16 is used as a sealing surface.

Typical back seals formed using the film composition shown in FIG. 1 are illustrated in FIGS. 2*a* and 2*b*. FIG. 2*a* is a schematic of a "lap seal" embodiment of a back seal being formed on a tube of film, which can be used when the outside and inside layers are sealable together. FIG. 2*b* illustrates a "fin seal" embodiment of a back seal being formed on a tube of film, which can be used when the outside layer is not suitable as a sealing surface.

With reference to FIG. 2*a*, a portion of the inside metalized layer 26 is mated with a portion of the outside layer 20 in the area indicated by the arrows to form a lap seal. The seal in this area is accomplished by applying heat and pressure to the film in such area. The lap seal design shown in FIG. 2*a* insures that the product to be placed inside the formed package will be protected from the ink layer by the metalized inside layer 26.

The fin seal variation shown in FIG. 2*b* also provides that the product to be placed in the formed package will be protected from the ink layer by the metalized inside layer 26. Again, the outside layer 20 does not contact any product. In the embodiment shown in FIG. 2*b*, however, the inside layer 26 is folded over and then sealed on itself in the area indicated by the arrows. Again, this seal is accomplished by the application of heat and pressure to the film in the area illustrated.

Regardless of whether a lap seal or fin seal is used for constructing a standard package using a vertical form and fill packaging machine, the end result is a package as shown in FIG. 3*a* with horizontally oriented top and bottom transverse seals 31, 33. Such package is referred to in the art as a "vertical flex bag" or "pillow pouch," and is commonly used for packaging snack foods such as potato chips, tortilla chips, and other various sheeted and extruded products. The back seal discussed with reference to FIGS. 2*a* and 2*b* runs vertically along the bag and is typically centered on the back of the package shown in FIG. 3*a*, thus not visible in FIG. 3*a*. Because of the narrow, single edge base on the package shown in FIG. 3*a* formed by the bottom transverse seal 33, such prior art packages are not particularly stable when standing on one end. This shortcoming has been addressed in the packaging industry by the development of a horizontal stand-up pouch such as the embodiment illustrated in FIGS. 4*a*, 4*b*, and 4*c*. As can be seen by reference to said figures, such horizontal stand-up pouch has a relatively broad and flat base 47 having two contact edges. This allows for the pouch to rest on this base 47 in a vertical presentation. Manufacture of such horizontal stand-up pouches, however, does not involve the use of standard vertical form, fill, and seal machines but, rather, involves an expensive and relatively slow 3-piece construction using a pouch form, fill, and seal machine.

Referring to FIGS. 4*b* and 4*c*, the horizontal stand-up pouch of the prior art is constructed of three separate pieces of film that are mated together, namely, a front sheet 41, a rear sheet 43, and a base sheet 45. The front sheet 41 and rear sheet 43 are sealed against each other around their edges, typically by heat sealing. The base sheet 45 is, however, first secured along its outer edges to the outer edges of the bottom of the front sheet 41 and rear sheet 43, as is best illustrated in FIG. 4*c*. Likewise, the mating of the base sheet 45 to the front sheet 41 and the rear sheet 43 is also accomplished typically by a heat seal. The requirement that such horizontal stand-up pouch be constructed of three pieces results in a package that is significantly more expensive to construct than a standard form and fill vertical flex bag.

Further disadvantages of using horizontal stand-up pouches include the initial capital expense of the horizontal stand-up pouch machines, the additional gas flush volume required during packaging as compared to a vertical flex bag, increased down time to change the bag size, slower bag forming speed, and a decreased bag size range. For example, a Polaris model vertical form, fill, and seal machine manufactured by Klick Lock Woodman of Georgia, USA, with a volume capacity of 60–100 bags per minute costs in the range of $75,000.00 per machine. A typical horizontal stand-up pouch manufacturing machine manufactured by Roberts Packaging of Battle Creek, Mich., with a bag capacity of 40–60 bags per minute typically costs $500,000.00. The film cost for a standard vertical form, fill, and seal package is approximately $0.04 per bag with a comparable horizontal stand-up pouch costing roughly twice as much. Horizontal stand-up pouches further require more than twice the oxygen or nitrogen gas flush. Changing the bag size on a horizontal stand-up pouch further takes in excess of two hours, typically, while a vertical form and fill machine bag size can be changed in a matter of minutes. Also, the typical bag size range on a horizontal stand-up pouch machine is from 4 oz. to 10 oz., while a vertical form and fill machine can typically make bags in the size range of 1 oz. to 24 oz.

One advantage of a horizontal stand-up pouch machine over a vertical form and fill machine, however, is the relatively simple additional step of adding a zipper seal at the top of the bag for reclosing of the bag. Vertical form and fill machines typically require substantial modification and/or the use of zipper seals premounted on the film oriented horizontally to the seal facings used to seal the horizontal transverse seals.

An alternative approach taken in the prior art to producing a bag with more of a stand-up presentation is the construction of a flat bottom bag such as illustrated in FIG. 3*b*. Such bag is constructed in a method very similar to that described above with regard to prior art pillow pouches. However, in order to form the vertical gussets 37 on either side of the bag, the vertical form, fill, and seal machine must be substantially modified by the addition of two movable devices on opposite sides of the sealing carriage that moves in and out to make contact with the packaging film tube in order to form the tuck that becomes the gussets 37 shown in FIG. 3*b*. Specifically, when a tube is pushed down to form the next bag, two triangular shaped devices are moved horizontally towards the packaging film tube until two vertical tucks are formed on the packaging film tube above the transverse seals by virtue of contat with these moving triangular shaped devices. While the two triangular shaped devices are thus in contact with the packaging tube, the bottom transverse seal 33 is formed. The package is constructed with an outer layer 30 that is non-sealable, such as paper. This causes the formation of a V-shaped gusset 37 along each vertical edge of the package when the transverse seals 31, 33 are formed. While the triangular shaped devices are still in contact with the tube of packaging material, the product is dropped through the forming tube into the tube of packaging film that is sealed at one end by virtue of the lower transverse seal 33. The triangular shaped devices are then removed from contact with the tube of packaging film and the film is pushed down for the formation of the next package. The process is repeated such that the lower transverse seal 33 of the package above and upper transverse seal 31 of the package below are then formed. This transverse seal is then cut, thereby releasing a formed and filled package from the machine having the distinctive vertical gussets 37 shown in FIG. 3*b*.

The prior art method described above forms a package with a relatively broad base due to the V-shaped vertical gussets 37. Consequently, it is commonly referred to in the art as a flat bottom bag. Such flat bottom bag is advantageous over the previously described horizontal stand-up pouch in that it is formed on a vertical form, fill, and seal machine, albeit with major modifications. However, the prior art method of making a flat bottom bag has a number of significant drawbacks. For example, the capital expense for modifying the vertical form, fill, and seal machine to include the moving triangular-shaped devices is approximately $30,000.00 per machine. The changeover time to convert a vertical form, fill, and seal machine from a standard pillow pouch configuration to a stand-up bag configuration can be substantial, and generally in the neighborhood of one-quarter man hours. The addition of all of the moving parts required for the triangular-shaped device to move in and out of position during each package formation cycle also adds complexity to the vertical form, fill, and seal machine, inevitably resulting in maintenance issues. Importantly, the vertical form, fill, and seal machine modified to include the moving triangular-shaped devices is significantly slower than a vertical form, fill, and seal machine without such devices because of these moving components that form the vertical gussets. For example, in the formation of a six inch by nine inch bag, the maximum run speed for a modified vertical form, fill, and seal machine using the triangular-shaped moving devices is in the range of 15 to 20 bags per minute. A standard vertical form, fill, and seal machine without such modification can construct a similarly sized pillow pouch at the rate of approximately 40 bags per minute.

Consequently, a need exists for a method to form a stand-up pouch, similar in appearance and functionality to the prior art horizontal stand-up pouches or prior art flat bottom bags, using vertical form, fill, and seal machine technology and a single sheet of packaging film. This method should allow for reduced film cost per bag as compared to horizontal stand-up pouches, ease in size change, and little capital outlay, all while maintaining bag forming speeds typical of vertical form, fill, and seal machine pillow pouch production. Such method should ideally produce a flat bottom bag constructed of material commonly used to form standard vertical flex bags without adding complexity or moving parts to a standard vertical form, fill, and seal machine.

SUMMARY OF THE INVENTION

The proposed invention involves producing a flat bottom bag having vertical gussets constructed of a single sheet of material using a vertical form, fill, and seal machine slightly modified with two pair of forming plates located below the forming tube and two stationary tucker mechanisms mounted to the frame of the machine. Each tucker mechanism is positioned between a pair of forming plates, thereby creating a vertical tuck along the length of the bag while it is being formed. The transverse seals on the formed bag are oriented horizontally when the bag is placed on display. The formed bag provides a stable "flat bottom" due to the "V" shaped gussets on each vertical side of the bag.

The method disclosed and the bag formed as a consequence is a substantial improvement over prior art stand-up pouches. The method works on existing vertical form and fill machines requiring very little modification. There are no moving parts or jaw carriage modifications involved. The bag makers can be easily converted back to a pillow pouch configuration with a simple former change. The same metalized or clear laminations used as materials in pillow pouches can also be used with the invention therefore saving in per bag cost.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 3*a* is a perspective view of a prior art vertical flex bag;

FIG. 3*b* is a perspective view of a prior art flat bottom bag;

DETAILED DESCRIPTION

Figure 1:
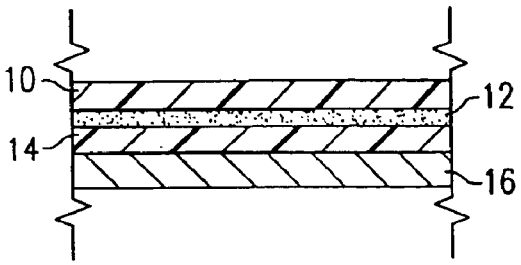
FIG. 1 (PRIOR ART)
FIG. 1 is a schematic cross-section views of prior art packaging films.
Figure 2A:
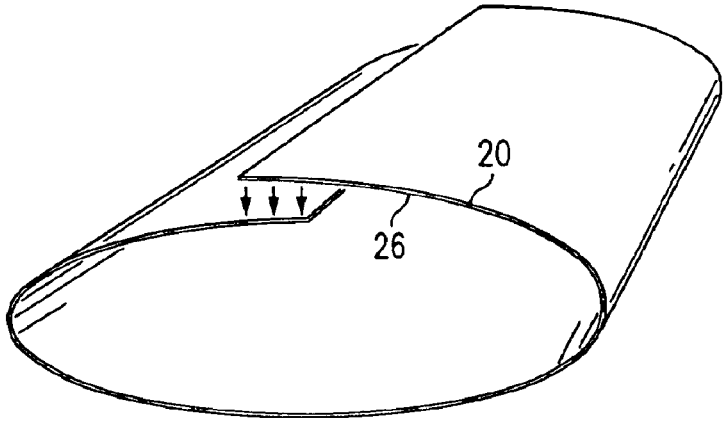
FIG. 2a (PRIOR ART)
FIG. 2*a* is a schematic cross-section view of a tube of packaging film illustrating the formation of a prior art lap seal.
Figure 2B:
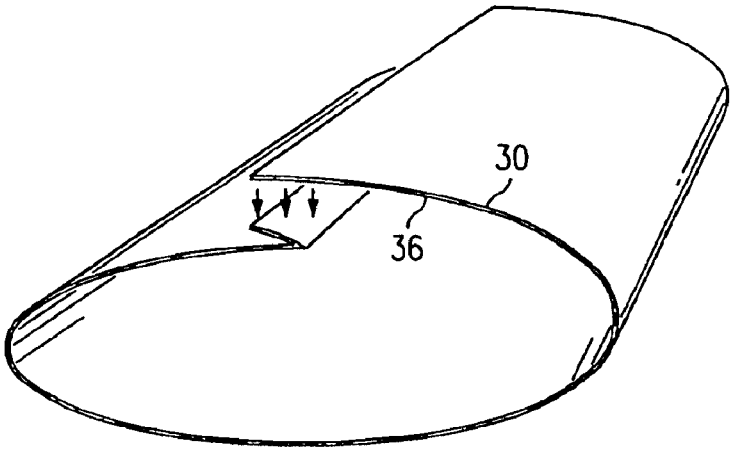
FIG. 2b (PRIOR ART)
FIG. 2*b* is a schematic cross-section of a tube of packaging film illustrating the formation of a prior art fin seal.
Figure 4A:
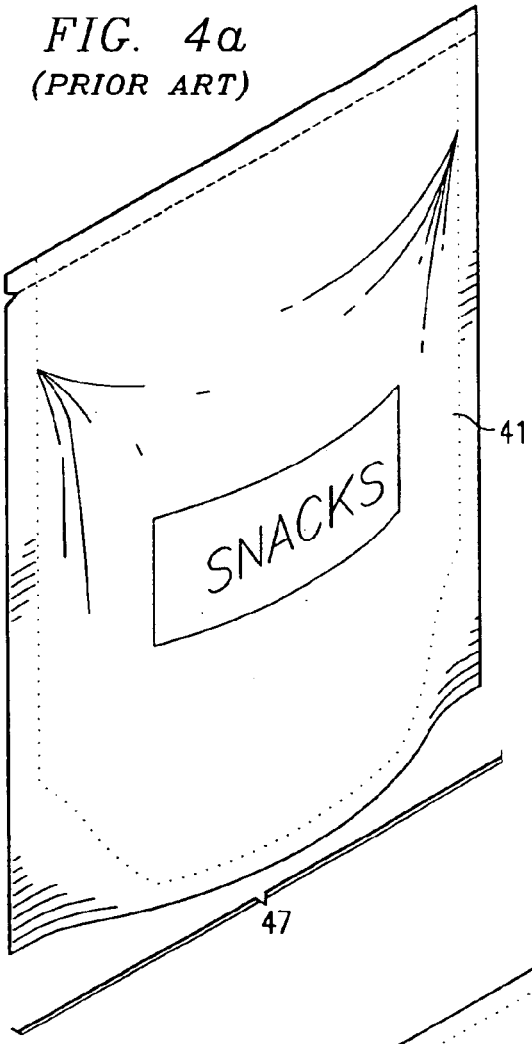
FIG. 4a (PRIOR ART)
FIGS. 4*a*, 4*b*, and 4*c* are perspective views in elevation of a prior art horizontal stand-up pouch.
Figure 4B:
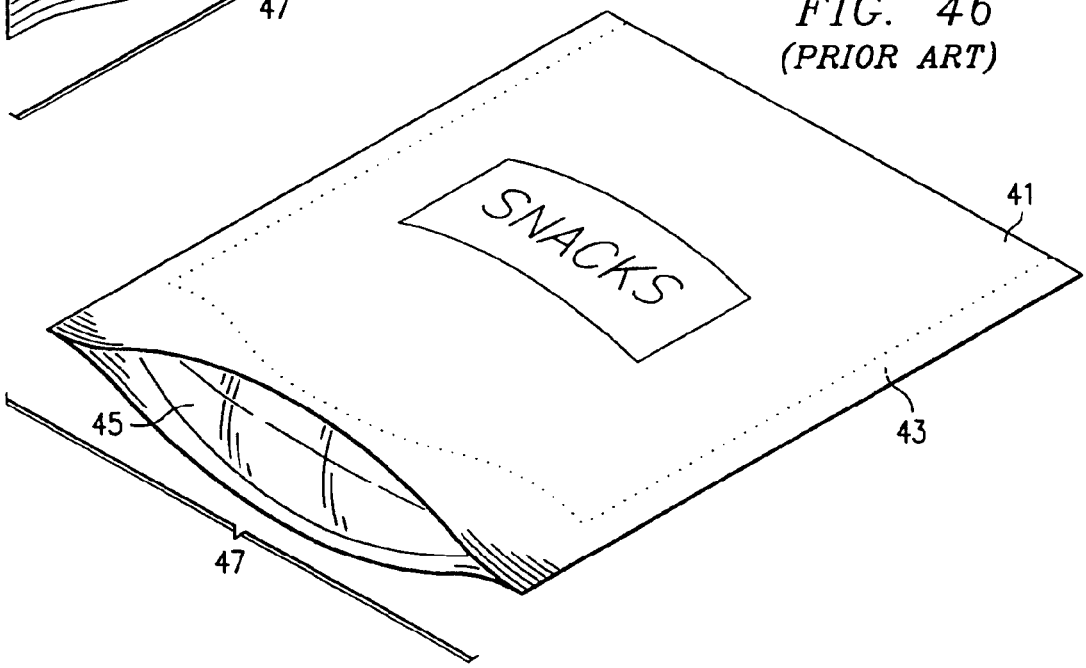
FIG. 4b (PRIOR ART)
Figure 4C:
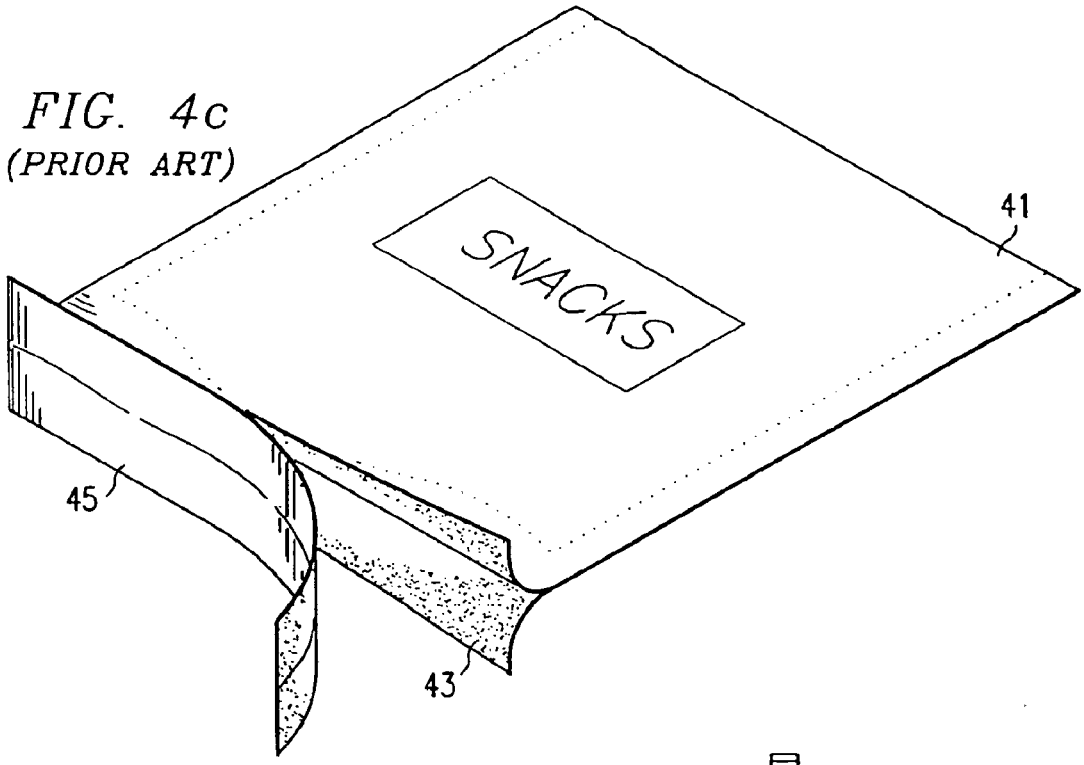
FIG. 4c (PRIOR ART)
Figure 5:
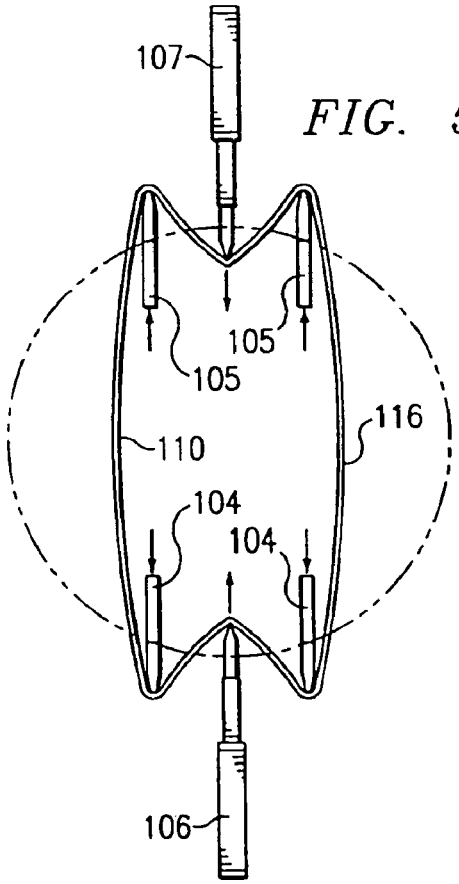
FIG. 5 is a schematic cross-section of a tube of packaging film formed by the present invention methods.
Figure 6:
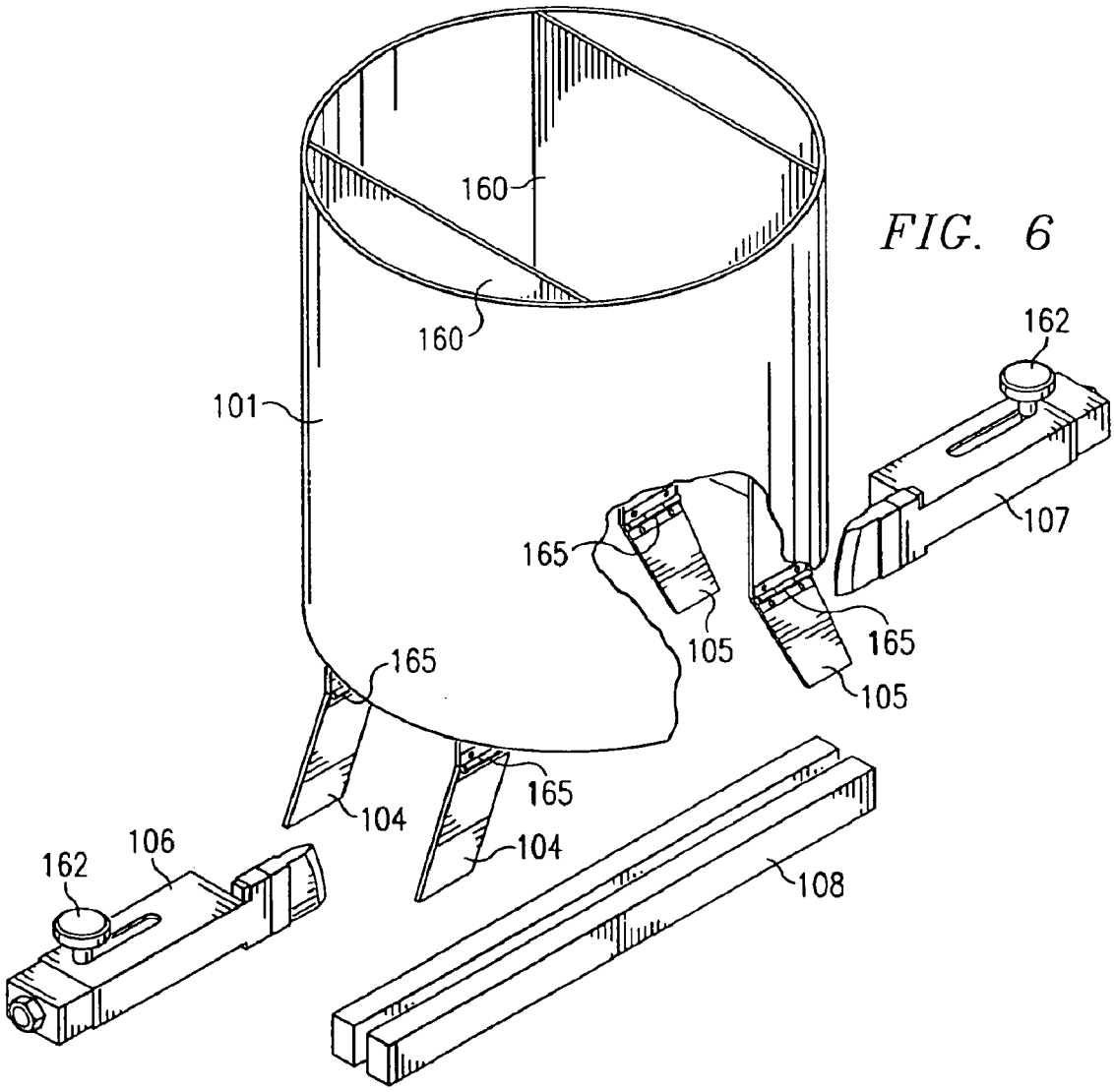
FIG. 6 is a perspective view of the tucker mechanism and forming plates in elevation of the present invention in relation to a forming tube and sealing jaws of a vertical form and fill machine.

FIGS. 5 and 6 illustrate the basic components used with the method of the proposed invention. The same reference numbers are used to identify the same corresponding elements throughout all drawings unless otherwise noted. FIG. 5 is a schematic cross-section of a tube of packaging material (film) formed by the present invention method. The tube of packaging film shown in FIG. 5 is illustrated as a cross-sectional area immediately below the forming tube 101 of FIG. 6 (shown in phantom in FIG. 5). The tube of packaging film comprises an outer layer 116 and an inner layer 110, and can comprise material typically used in the field of art for making a standard vertical flex bag, such as discussed in relation to FIG. 1. However, for reasons that will become apparent from the discussion below, a preferred embodiment of the bag of the present invention comprises an outside layer 112 that is not sealable on itself, such as paper. The tube in FIG. 5 has been formed by sealing one sheet of film with a vertical back seal, as previously described with regard to discussions of prior art vertical form and fill machine methods.

FIG. 6 shows a forming tube 101 typical in most respects to those used with prior art vertical form, fill, and seal machines. This forming tube 101 can be a cylinder, have a rectangular cross section, or any number of shapes, but is preferably cylindrical as illustrated. The film illustrated in FIG. 5 is initially formed around the forming tube 101 of FIG. 6. This forming tube 101 is shown in elevation but would normally be integrally attached to the vertical form, fill, and seal machine. Also shown in FIG. 6 are a pair of prior art sealing jaws 108 likewise illustrated in elevation. Not shown in FIG. 6 is the sealing jaw carriage on which such sealing jaws 108 would be mounted below the forming tube 101.

As previously described, the practice in the prior art in the manufacture of a vertical flex bag involves feeding a continuous packaging film directed around the forming tube 101. A back seal is formed on a single layer of film in order to create a tube of film around the forming tube 101. The seal jaws 108 close on the thus formed tube of packaging film, thereby forming a bottom transverse seal. Product is then dropped through the forming tube 101 into the tube of packaging film. The tube is then driven downward by friction against rotating belts (not shown) and the seal jaws 108 are used to form another transverse seal above the level of the product found inside the tube. This seal is subsequently cut horizontally such that a top transverse seal is formed at the top of the filled bag below and a bottom transverse seal is formed on the tube of packaging film above. The packaging film during the prior art operation described above is oriented to be readable by an operator of the machine as the film travels down the forming tube 101. This orientation provides graphics 39 on the formed prior art bag that are readable by a consumer when the formed bag is placed on a retail display shelf while resting on its bottom transverse seal 33 as seen in FIG. 3*a*.

The invention adds two basic components to a prior art vertical form, fill, and seal machine. Two pair of stationary or fixed forming plates 104, 105 are used to hold the packaging film tube in tension from inside the tube, as indicated by the arrows illustrated on FIG. 5. As shown in FIG. 6, the forming plates 104, 105 can be attached directly to the forming tube 101 or, alternatively, to any supporting structure on the vertical form, fill, and seal machine, as long as the forming plates 104, 105 are positioned within the tube of packaging material, below the bottom of the forming tube 101, and above the heat sealing jaws 108.

Tension is applied on the outside of the film and in the opposite direction of the tension provided by the forming plates 104, 105 by two stationary or fixed tucker mechanisms 106, 107, alternatively referred to herein as tucker bars 106, 107, positioned between said forming plates 104, 105. The tucker bars 106, 107 are preferably attached to the sealing carriage for the vertical form, fill, and seal machine and are adjustable along all three axes (in/out, up/down, and front/back). Alternatively, the tucker bars 106, 107 can be attached to the frame of the vertical form, fill, and seal machine or any other point that can supports their function outside the film tube. These adjustments in all three axes allow for the tucker bars 106, 107 to be easily moved out of the way to convert the vertical form and fill machine back to standard operation and is accomplished, in the embodiment shown in FIG. 6, by a tension screw 162 that can lock the tucker bars 106, 107 in place when tightened. While the tucker bars 106, 107 are adjustable, unlike in the prior art, they are fixed or stationary during operation. Therefore, the present invention is a substantial improvement over the art in that there are no moving parts to the tucker mechanism during bag making. This improvement is what Applicants intend to describe when referring to the tucker bars 106, 107 as "stationary" or "fixed." Because of this stationary tucker bar feature, bag making speeds can match typical pillow pouch manufacturing rates, modification costs are low (such as 3 to 4 thousand dollars per machine), and no additional maintenance issues are introduced.

When moved forward into position (toward the forming plates 104, 105), the tucker bars 106, 107 provide a crease or fold in the tube of the packaging film between the two forming plates 104, 105. This crease is formed prior to formation of the transverse seal by the seal jaws 108. Consequently, once the transverse seal is formed, the crease becomes an integral feature of two sides of the package, referred to as gussets. As shown in FIG. 3*b*, these gussets 37 form a "V" shape on each end of the horizontal transverse seals 31, 33 because the outer layer of packaging film used to form the bag comprises a material that does not seal on itself, such as paper. In an alternative embodiment, the outside layer 30 of the film comprises a material that seals on itself, thereby closing the ends of the "V" shaped gussets illustrated in FIG. 3*b*.

After the transverse seals are formed, the vertical form and fill machine thereafter operates basically as previously described in the prior art, with the sealing jaws 108 forming a lower transverse seal, product being introduced through the forming tube 101 into the sealed tube of packaging film (which now has a vertical crease on two opposite sides), and the upper transverse seal being formed, thereby completing the package. A major difference between a prior art package and Applicants' package, however, is that a gusset is formed on each side of the package of the present invention using the fixed mechanism described.

An example of the formed package of the instant invention is shown in FIG. 3*b*, which shows the outside layer of the packaging film 30 with the graphics 38 oriented as previously described. As can be seen from FIG. 3*b*, the construction of the invention's flat bottom bag shares characteristics with the prior art vertical flex bags shown in FIG. 3*a*. FIG. 3*b* shows the gussets 37 that were formed by the tucker bars 106, 107 and forming plates 104, 105 discussed in relation to FIGS. 5 and 6.

Returning to FIG. 6, another optional feature that can be incorporated into this invention is the use of one or two diversion plates 160 within the forming tube 101. These diversion plates 160, in the embodiment illustrated, comprise a flat plate welded vertically inside the forming tube 101 that extends from the bottom of the forming tube 101 to some distance above (for example, at least two or three inches) the bottom of the forming tube 101, where it then is sealed against the inside of the forming tube 101.

The diversion plates 160 in a preferred embodiment accomplish two functions. First, the diversion plates 160 keeps product that is dropped down the forming tube 101 away from the area where the crease is being formed on the tube of packaging film. Second, the diversion plates 160, if properly sealed against the forming tube 101, can be used as channels for a gas or nitrogen flush. In such instance, at least one, but preferably both diversion plates 160 at some point above the bottom of the forming tube 101 seal at the top of the plate 160 against the forming tube 101. Below such seal (not shown) one or more orifices can be drilled into the forming tube 101 in order to provide gas communication between an exterior gas (for example, nitrogen or oxygen) source and the cavity formed between a diversion plate 160 and the interior of the forming tube 101. The diversion plates 160 are shown in FIG. 6 as a flat plate, but it should be understood that they could be of any variety of shapes, for example, having a curved surface, provided that they accomplish the functionality of diverting the product away from the area where the tucks are formed on the tube of film.

By using one or more of the diversion plates 160 as a channel for the gas flush, the present invention eliminates the need for a separate gas tube to be placed inside the forming tube 101 that normally accomplishes the same function in the prior art. The added benefit of providing a relatively large volume channel formed by a diversion plate 160 and the interior of the forming tube 101 is that a relatively large volume of flushing gas can be introduced into a filled and partially formed package at a significantly lower gas velocity compared to prior art gas tubes. This allows for the filling of packages using this embodiment of the present invention that may contain low weight product that might otherwise be blown back into the forming tube by prior art flushing tubes.

Figure 7:
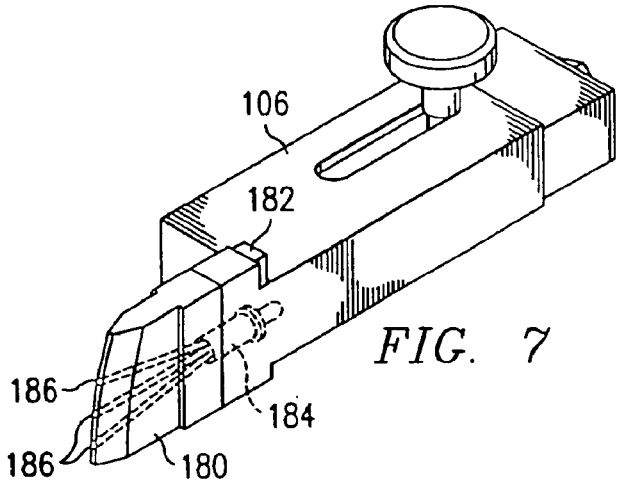
FIG. 7 is a perspective view of one embodiment of the tucker mechanism of the present invention.

FIG. 7 illustrates a preferred embodiment of a tucker bar 106. This embodiment of a tucker bar 106 comprises a head 180 attached to a support 182. Drilled within the support 182 and head 180 is a gas channel 184 shown in phantom on FIG. 7. This gas channel 184 provides a gas communication from an exterior gas source (not shown) through the support 182, the head 180, and out three orifices 186. The gas channel 184 allows for a metered burst of pressurized gas (typically air) that helps keep the tuck illustrated in FIG. 5 taut throughout the forming and sealing operation without the necessity of moving the tucker bar in and out during bag formation. It should be noted that during operation (bag making) the tucker bar 106 is always stationary. It should further be noted that the head 180 necessarily cannot extend along the entire length of the crease formed by the tucker bar 106 and forming plates 104. Further, it should be understood that when the sealing jaws 108 close onto the tube of film, the lateral dimensions of the tube of film change. All of these facts are compensated for by the use of the pressurized air bursting from the orifices 186. The pressurized air keeps an even amount of pressure on the tuck as it is being formed in the various stages of the forming and sealing process. The air burst can be continuous, but is preferably metered to start as the film for the next bag is being pulled down through the completion of the transverse seal.

The head 180 can comprise any non-stick material but is preferably a fluoropolymer, such as Teflon®. In an alternative embodiment, the tucker bar 106 can comprise one integral piece of metal with the head portion 180 being coated with a fluoropolymer. The curved contact area of the head 180 allows for the continuous formation of the tuck illustrated in FIG. 5 without tearing the packaging film as it is pushed down below the forming tube. While shown with three orifices 186, the head 180 can comprise any number of orifices from one on.

To further compensate for the change in the width of the film tube as the transverse seal is formed by the seal jaws 108 of FIG. 6, it should be noted that the forming plates 104, 105 are hinged by a horizontal hinge 165. The forming plates 104, 105 comprise horizontal hinges 165 that allow the forming plates to fold inward (toward each other) slightly while the lower transverse seal is formed. Otherwise, the tube of packaging film would be ripped by the tips of the forming plates 104, 105 during this step.

The present invention offers an economic method of producing a flat bottom bag with numerous advantages over prior art horizontal stand-up pouches and methods for making them. Examples of these advantages are illustrated in Table 1 below.

TABLE 1

| | Current Vertical Flex Bag | Commercially Available Horizontal Stand-Up Pouches | Applicants' Flat Bottom Bag |
|---|---|---|---|
| Machine Type | Standard Vertical FFS | Pouch Form, Fill, Seal | Standard Vertical FFS |
| Machine Cost | $75,000.00 | $500,000.00 | $75,000.00 |
| Film Cost | $0.04/bag | $0.08/bag | $0.04/bag |
| Gas Flush | Less than 2% $O_2$ | Only to 5% $O_2$ | Less than 2% $O_2$ |
| Size Change | Easy, change former | 2 hours | Easy, change former |
| Format Change | Flex Bag Only | Stand-Up Pouch Only | Both, simple change |
| Bag Size Range in Inches | (Width/Height) 5/5 through 14/24 | (Width/Height) 5/5 through 10/12 | (Width/Height) 5/5 through 11/24 |

Further, the speed at which a form, fill, and seal machine modified by Applicants' invention can run is not compromised by the modification, as is the case with the prior art method for making a flat bottom bag using a triangular-shaped device that is moved in and out during operation. In fact, Applicants' invention allows bag production rates on the order of twice as fast as the prior art method for making the same style bag.

In addition, the lack of moving parts associated with the tucker mechanism of Applicants' invention greatly reduces the cost of converting a vertical form, fill, and seal machine to manufacturing flat bottom bags, as well as reduces maintenance issues involved thereby. For example, converting a vertical form, fill, and seal machine to a flat bottom bag configuration using prior art devices that move in and out during operation costs in the range of $30,000.00 per machine. Applicants' invention involves retrofitting existing vertical form, fill, and seal machines at a fraction, approximately 1/10th, of that cost.

While the invention has been particularly shown and described with reference to a preferred embodiment, it will be understood by those skilled in the art that various changes in form and detail may be made therein without departing from the spirit and scope of the invention.

What is claimed is:

1. An improved vertical form, fill, and seal machine having a single back sealer for making a back seal, a pair of sealing jaws for making transverse seals, and a vertical forming tube, said improvement comprising:

two pairs of forming plates attached to and extending below said forming tube;

at least one stationary tucker bar positioned between each pair of said forming plates, wherein said forming plates and tucker bars create a pair of gussets on a packaging tube, wherein either of said gussets provides a flat bottom after formation of said transverse seals; and means for removably mounting said two pairs of plates below the forming tube to allow conversion of the forming tube to an operation without the use of said plates.

2. The improved vertical form, fill, and seal machine of claim 1 further comprising a means for blowing a pressurized gas against packaging film formed in a tube around said forming tube, wherein said gas is blown against the exterior of said tube of packaging film at points between each said pair of forming plates.

3. The improved vertical form, fill, and seal machine having a forming tube, said improvement comprising:

two pairs of forming plates attached to and extending below said forming tube;

at least one stationary tucker bar positioned between each pair of said forming plates, and further comprising a means for blowing a pressurized gas against packaging film formed in a tube around said forming tube, wherein said gas is blown against the exterior of said tube of packaging film at points between each said pair of forming plates, wherein said means for blowing a pressurized gas comprises gas ports in said tucker bar in communication with a pressurized gas source.

4. The improved vertical form, fill, and seal machine of claim 1 wherein said tucker bar comprises a fluoropolymer.

5. The improved vertical form, fill, and seal machine of claim 1 wherein each of said forming plates comprise a hinge, wherein further said hinges allow for a pair of forming plates to rotate about said hinges towards each other to compensate for the narrowing of a packaging tube during formation of a transverse seal.

* * * * *